US007326154B2

(12) United States Patent
Foley

(10) Patent No.: US 7,326,154 B2
(45) Date of Patent: Feb. 5, 2008

(54) EXERCISE EQUIPMENT PACK

(76) Inventor: John Foley, 12 Vera Pl., Montclair, NJ (US) 07042

( * ) Notice: Subject to any disclaimer, the term of this patent is extended or adjusted under 35 U.S.C. 154(b) by 0 days.

(21) Appl. No.: 11/401,406

(22) Filed: Apr. 11, 2006

(65) Prior Publication Data

US 2006/0229173 A1 Oct. 12, 2006

Related U.S. Application Data

(60) Provisional application No. 60/670,131, filed on Apr. 11, 2005.

(51) Int. Cl.
*A63B 21/065* (2006.01)

(52) U.S. Cl. ..... 482/105; 482/104; 482/98; 206/315.1

(58) Field of Classification Search ..... 482/105, 482/104, 98, 108, 910, 141, 123, 412, 106, 482/121; 206/315.1; D21/683; 405/186
See application file for complete search history.

(56) References Cited

U.S. PATENT DOCUMENTS 4,431,185 A * 2/1984 Cisneros ..... 482/93
4,944,509 A * 7/1990 Snider ..... 482/105
4,948,122 A * 8/1990 Andrews, Sr. ..... 482/105
5,042,796 A * 8/1991 Jibril ..... 482/105
5,167,600 A * 12/1992 Baird ..... 482/105
5,299,999 A * 4/1994 Brine ..... 482/105
5,607,380 A 3/1997 Duty
5,709,634 A * 1/1998 Pointer ..... 482/105
5,997,442 A 12/1999 Cordes
6,123,651 A * 9/2000 Ellenburg ..... 482/104
6,216,926 B1 * 4/2001 Pratt ..... 224/153
6,675,391 B2 * 1/2004 Morrison ..... 2/102
7,001,315 B1 * 2/2006 Diodati ..... 482/121

* cited by examiner

*Primary Examiner*—Lori Amerson
*Assistant Examiner*—Sundhara M Ganesan
(74) *Attorney, Agent, or Firm*—Dickstein,Shapiro, LLP.

(57) ABSTRACT

An exercise equipment pack is adapted to assist a user in performing one or more exercises. The equipment pack includes a base frame. The base frame includes: a front substantially-cylindrical canister portion, formed integrally with the base frame and projecting therefrom; a rear substantially-cylindrical canister portion, formed integrally with the base frame, and projecting therefrom in a direction opposite from the front canister portion; and a common wall, formed integrally with the base frame and forming a common inner base surface for both the front canister portion and the rear canister portion, the common wall having an opening. The front canister portion, the rear canister portion and the common wall together forming a cylindrical storage area divided by the common wall, the cylindrical storage area being adapted to securely maintain one or more weights on each side of the common wall.

8 Claims, 12 Drawing Sheets

EXERCISE EQUIPMENT PACK

CROSS-REFERENCE TO RELATED APPLICATION

This application claims benefit under 35 U.S.C. 119(e) of U.S. Provisional Application No. 60/670,131, filed Apr. 11, 2005, the contents of which are incorporated by reference herein.

BACKGROUND

Field of the Invention

The present invention relates to fitness equipment, and more specifically to a weighted fitness equipment which enables the action of push-ups, sit-ups, dips, leg exercises and assorted hand-held dumbbell bar exercises.

SUMMARY OF THE INVENTION

The total body fitness equipment of the present invention relates to a fitness pack which would augment the natural body weight of the user with free weight plates and which would enable the user to exercise the action of a weighted push-up when the invention is strapped to a person's back area, and which would also enable the user to exercise the action of a weighted sit-up when the pack is strapped to the user's chest area.

In accordance with one aspect of the present invention, there is provided an exercise equipment pack adapted to assist a user in performing one or more exercises. The equipment pack includes a base frame. The base frame includes: a front substantially-cylindrical canister portion, formed integrally with the base frame and projecting therefrom; a rear substantially-cylindrical canister portion, formed integrally with the base frame, and projecting therefrom in a direction opposite from the front canister portion; and a common wall, formed integrally with the base frame and forming a common inner base surface for both the front canister portion and the rear canister portion, the common wall having an opening. The front canister portion, the rear canister portion and the common wall together forming a cylindrical storage area divided by the common wall, the cylindrical storage area being adapted to securely maintain one or more weights on each side of the common wall.

In a preferred embodiment, the one or more weights, each having an opening therethrough, are securely fastenable to the base unit by means of the pin passing through the openings in the one or more weights on the front side of the common wall, the opening in the common wall, and the openings in the one or more weights on the rear side of the common wall.

In accordance with another aspect of the present invention, there is provided exercise equipment kit comprising: (1) an exercise equipment pack adapted to assist a user in performing one or more exercises, the equipment pack comprising: (a) a base frame, the base frame including: a front substantially-cylindrical canister portion, formed integrally with the base frame and projecting therefrom; a rear substantially-cylindrical canister portion, formed integrally with the base frame, and projecting therefrom in a direction opposite from the front canister portion; a common wall, formed integrally with the base frame and forming a common inner base surface for both the front canister portion and the rear canister portion, the common wall having an opening; and storage portions integrally formed in the base frame, the front canister portion, the rear canister portion and the common wall together forming a cylindrical storage area divided by the common wall, the cylindrical storage area being adapted to securely maintain one or more weights on each side of the common wall; and (b) a pin; (2) the weights; (3) one or more threaded collars; (4) dumbbell handles, the dumbbell handles adapted to engage the weights and the threaded collars to form free weight dumbbells; and (5) push up stands.

It is an object of the present invention to have a fitness equipment which allows the user to add or remove free weight plates to achieve the desired resistance level. It is another object of the present invention to provide a fitness equipment kit which provides hand-grip stands which raise the user off the ground to increase the user's range of motion while doing weighted push-ups, and thus increasing the effectiveness of the exercise.

It is still another object of the present invention to provide a fitness equipment kit which provides hand-held dumbbell bars for enabling an additional variety of arm, shoulder, back, and leg exercises. It is yet another object of the present invention to provide a fitness equipment which comprises two molded hand cutouts to enable the user to stabilize and balance the lower portion of the fitness equipment when the weighted pack is resting on the user's chest area while doing weighted sit-ups. The structure and design of the fitness Equipment allows for a more functional, effective, and convenient exercise of the muscles of the total body, particularly the upper body when the weighted pack is used in a push-up position, sit-up position, or doing assorted exercises with the attached hand-held dumb-bell bars. The fitness equipment is also designed for ease of storing when not is use, and for portability when traveling. It is still another aspect of the present invention to have a preferably removable, hinged rear cover connected to the base frame pack to hide the numerous components attached to the rear of the base pack.

BRIEF DESCRIPTION OF THE DRAWINGS

For the purposes of illustrating the present invention, there is shown in the drawings a form which is presently preferred, it being understood however, that the invention is not limited to the precise form shown by the drawings in which.

DETAILED DESCRIPTION OF THE PREFERRED EMBODIMENT

Figure 1:
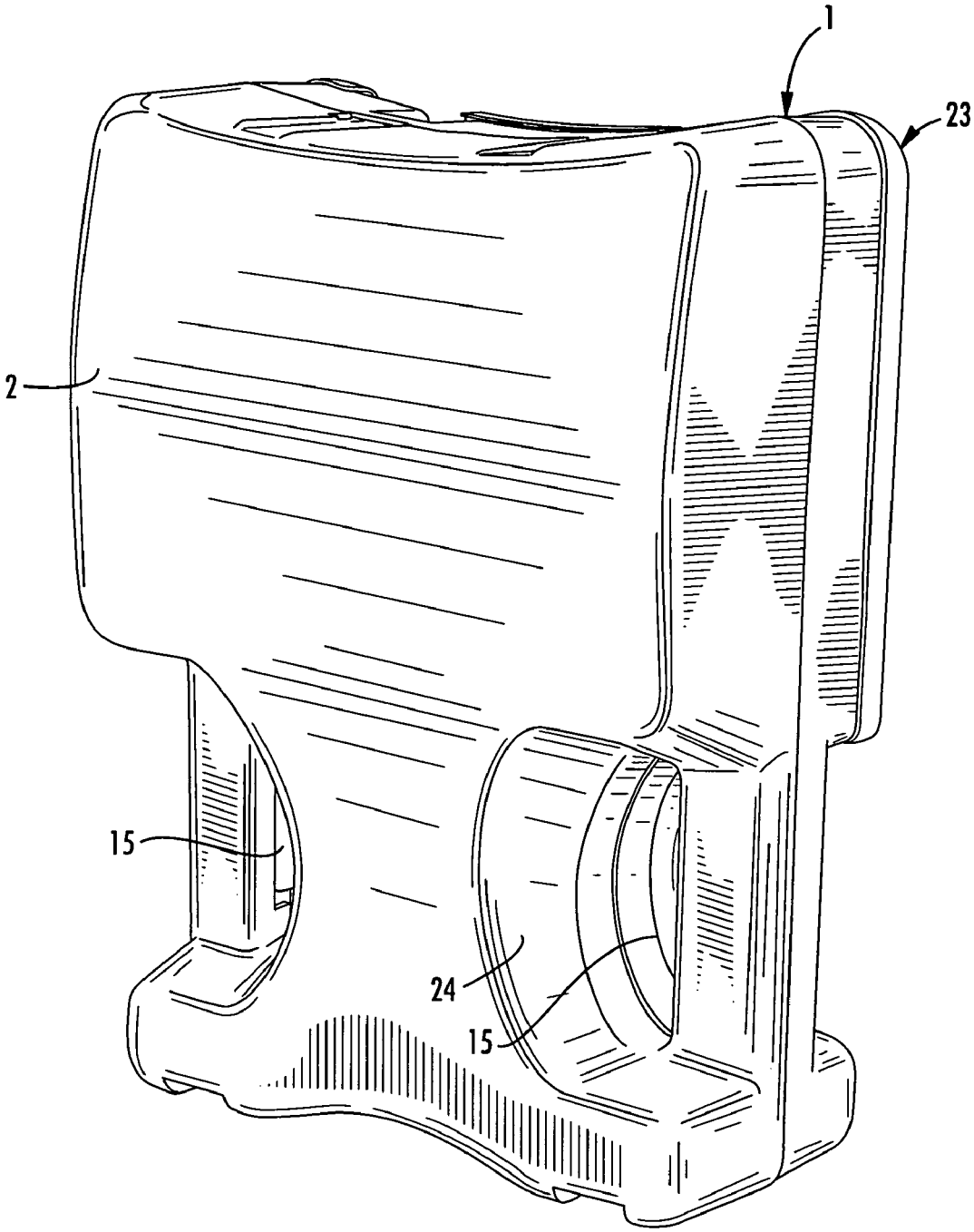
FIG. 1 is a rear perspective view of an exercise equipment according to the present invention.

Referring to FIGS. 1-12 a fully populated fitness equipment in accordance with a preferred embodiment of the present invention includes a base frame pack (1) with shoulder straps (16) and waist belt (25), molded front (3) and rear (4) circular canisters. A threaded bar (6) can be inserted through the center support wall (22) of both front and rear canisters. The threaded bar (6) engages a screw-on collar (5) to secure one or more free weight plates on each side of the support wall. Two hand-held dumbbell bars (29) are provided, with additional threaded collars (5), to secure free weight plates to those bars. Also provided are two semi-circular hand-grips (9) attach to their push-up platform stands (7),two molded hand cut-outs (15) formed by curved molded portions (24) a removable rear storage cover (2) and a preferably non-removable hinged front side lumbar cover (23).

FIG. 1 illustrates the rear view of an exemplary embodiment of fitness equipment with a removable rear storage cover (2), attached to the base pack (1), which can protect fitness components that may be stored in the base pack. Cut-out holes (15) therethrough are provided for ease of handling when transporting or while exercising in certain actions. The removable rear cover (2) is preferably secured with an upper set of male-ended clips (28) on the top side of the cover and female-ended clips (20) on the top side of the base pack (1). The removable rear cover (2) preferably opens down to the bottom of the base pack (1) with a set of dual sided open hinges (21) on both the base pack (1) and a corresponding set of open hinges (27) on the bottom of the removable rear cover (2).

Figure 2:
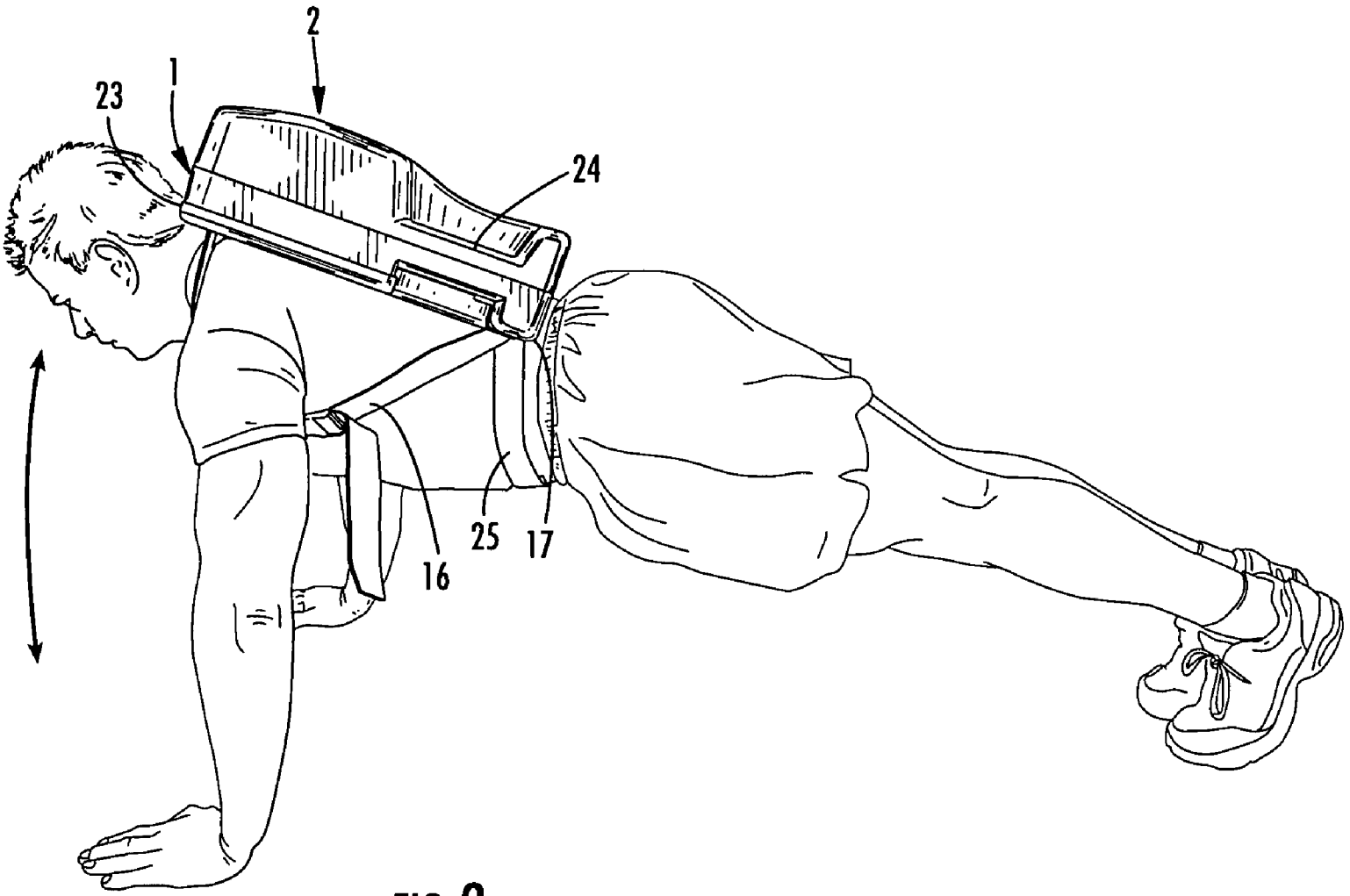
FIG. 2 is a view of the right side of exercise equipment according to the present invention when being used in the push-up position.

FIG. 2 illustrates the fitness equipment resting on the user's back while in the action of a "push-up" for developing upper body muscles. The rear side storage cover (1) is still attached, although it need not be to perform the exercise. The exercise pack is preferably attached to the user by use of shoulder straps (16) and a waist belt (25). The shoulder straps (16) will ensure the stability and balance of the upper portion of the weighted base pack (1) when the straps are secured over the shoulder, front to back. A waist belt (25) will wrap around the user and prevent lateral sway of the base pack (1). The preferred embodiment of left shoulder strap is depicted and is shown to be in two pieces with a release buckle connecting both ends. The right strap would preferably be the same. The shoulder straps (16) and waist belt (25) are preferably anchored to base pack (1) at the bottom portion on the front left and right side of the pack (17).

Figure 3:
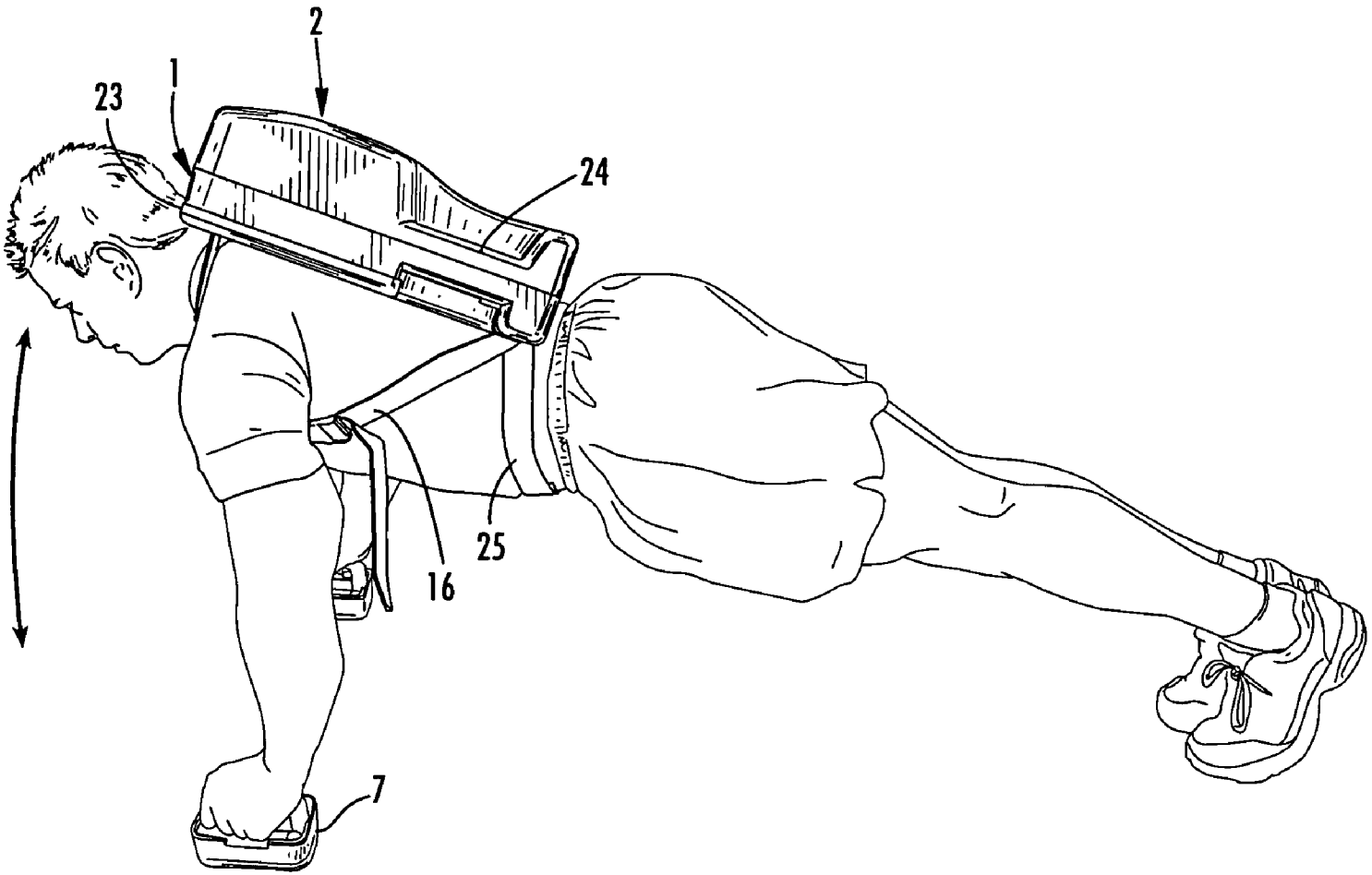
FIG. 3 is a view of the right side of exercise equipment according to the present invention when being used in the push-up exercise position with the elevating push-up stands.

FIG. 3 illustrates the user having the weighted push-up pack resting on their back to facilitate the action of weighted push-ups, preferring to use two semi-circular push-up hand-grips stands (9) that can be detached from the base pack push-up stand holders (8) and used to increase the user's range of motion during the exercise.

Figure 4:
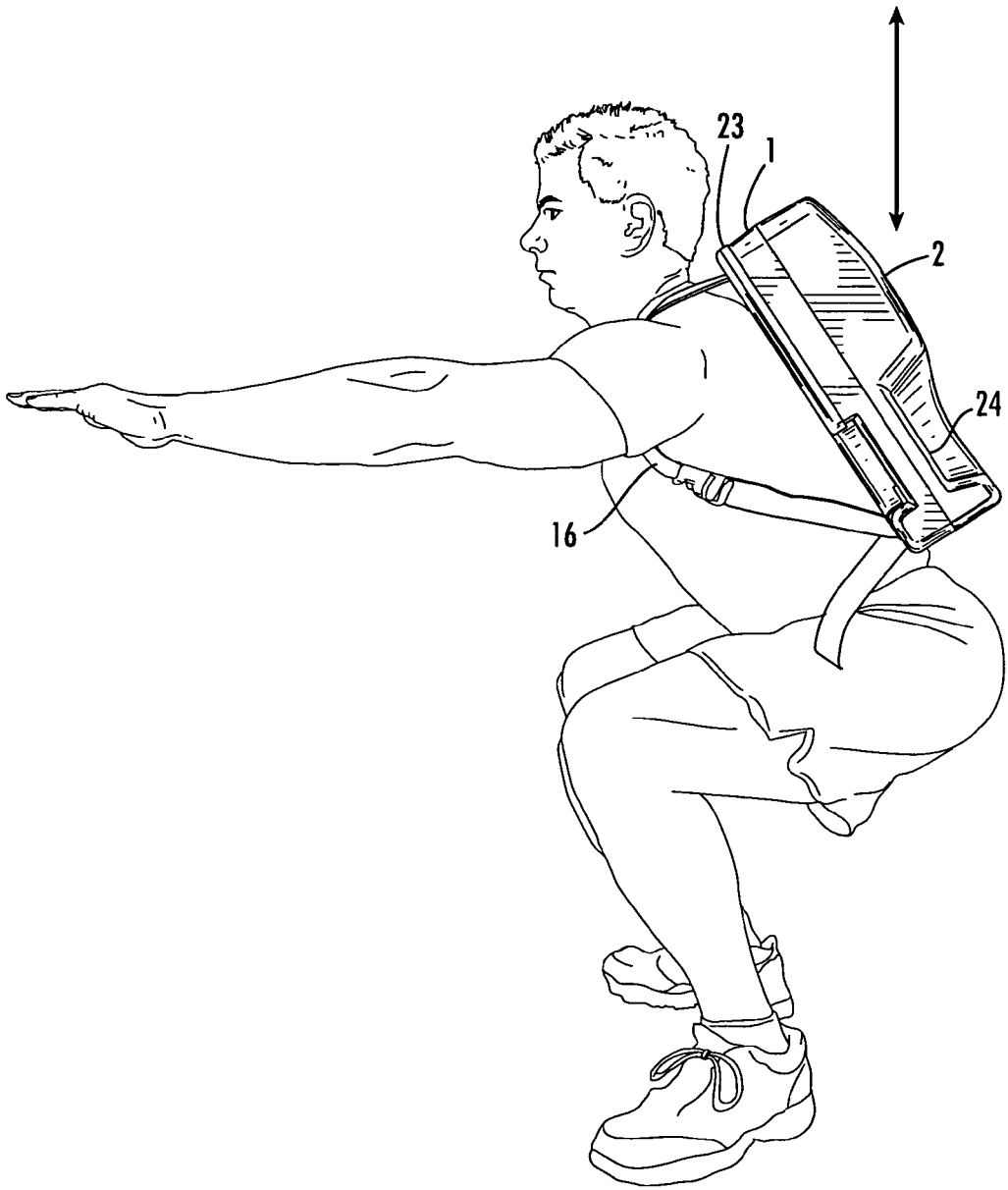
FIG. 4 is a view of the right side of exercise equipment according to the present invention when being used in the leg squatting exercise position.

FIG. 4 depicts the user in the action of weighted knee bend "squats" for developing the muscles of the legs. The rear side storage cover (2) is attached to the base (1).

Figure 5:
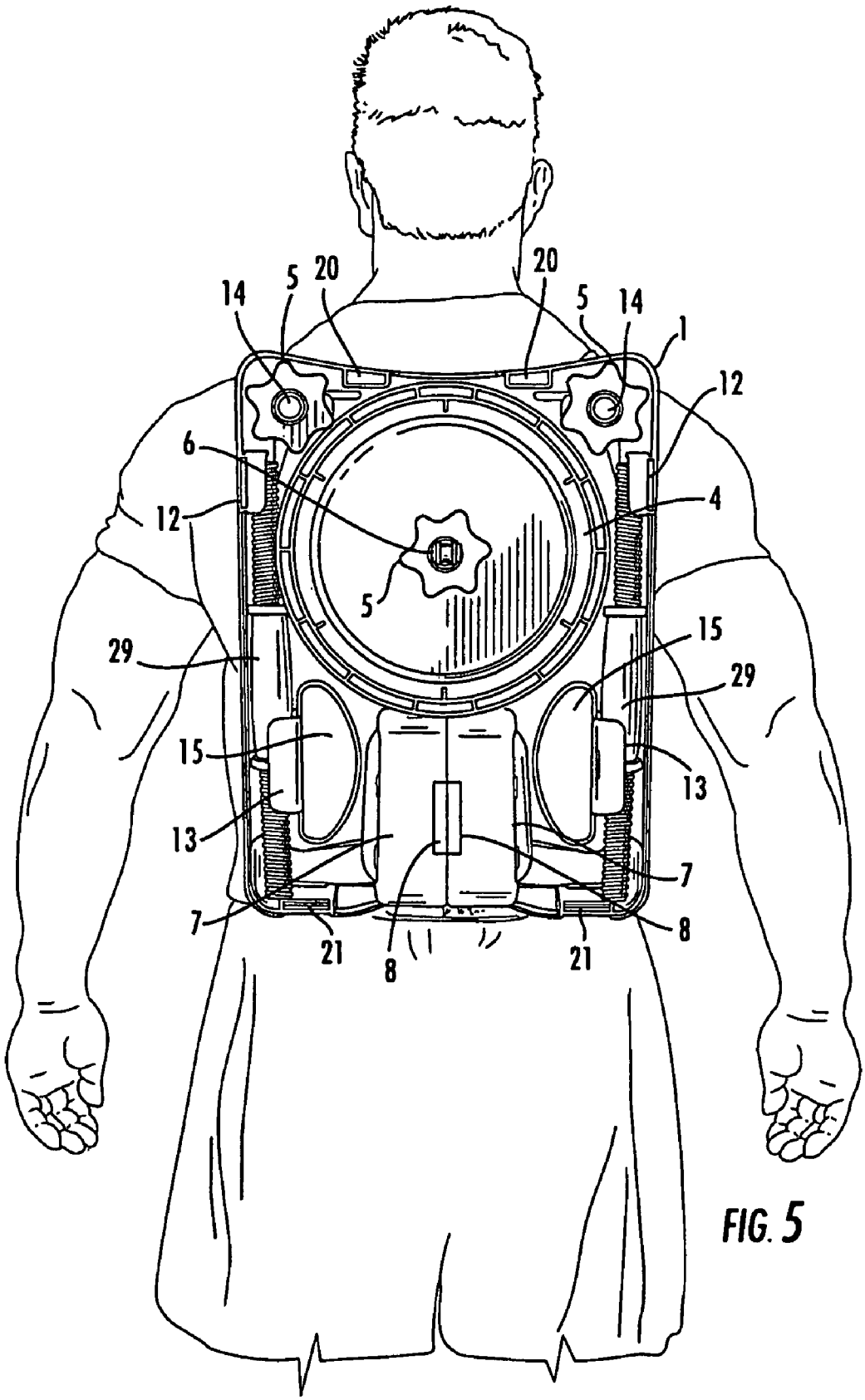
FIG. 5 is a rear view of the weighted open exercise equipment according to the present invention when on the user's back without the rear cover when populated with the weight plates, hand grip stands, hand dumbbell bars, bar collars.
Figure 6:
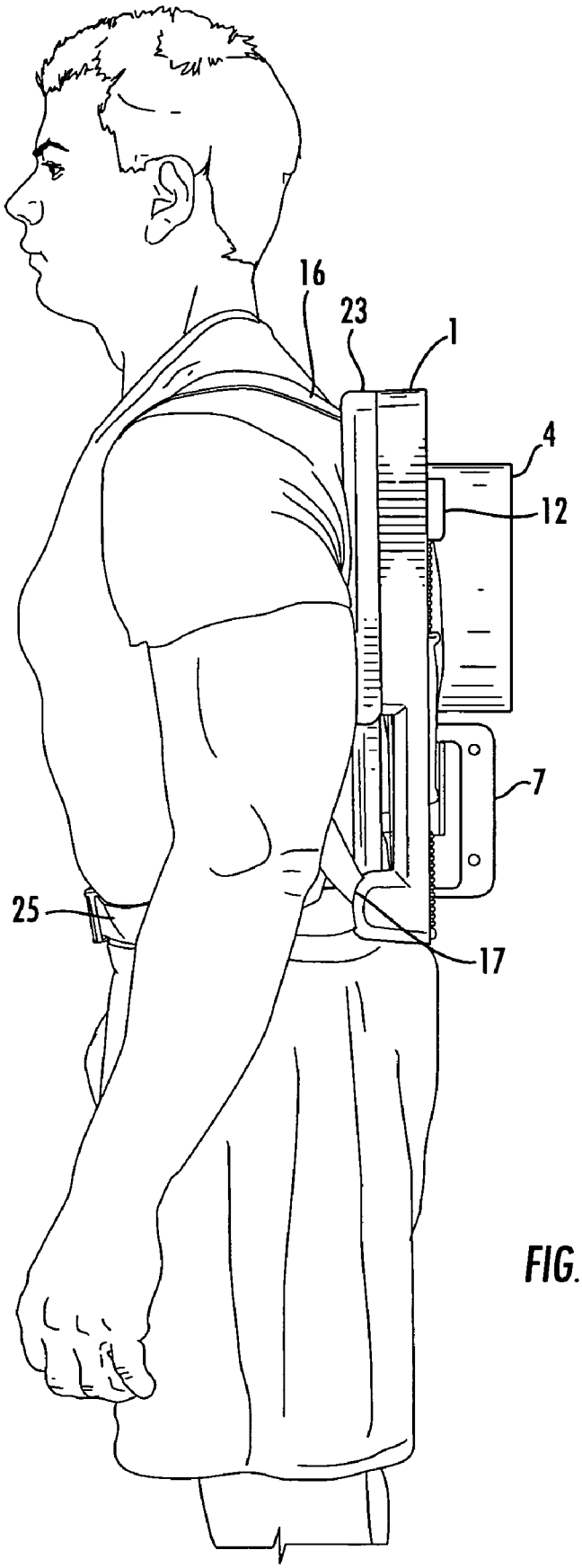
FIG. 6 is a view of the right side of exercise equipment according to the present invention when strapped on the user's back without rear cover.

FIGS. 5 and 6 illustrate respectively a rear and side view of the base exercise pack resting on the user's back with rear side storage cover removed, showing the numerous components that can be stored on the exercise equipment. When weight plates are deployed in the rear side canister (4) a threaded pin (6) collar (5) are used to secure them. Of course, weights can also be deployed on the front side canister, or in both canisters. Two push-up stands (7) sit securely below the rear-side weight canister (4) when not in use. Two parallel, longitudinally disposed form fitting slots (11) on each side of the rear of the pack secure the hand-held dumbbell bars (29) to the pack (1) when not in use, and are firmly reattached by a set of upper bar tab holders (12), and a set of lower bar tab holders (13). Four additional threaded collars (5), which are stored on two parallel but opposite side threaded pins (14), two threaded collars (5) on each pin (14). When weight plates are used on the dumbbell bars (29) collars should be removed from their resting pins (14) and screwed onto the dumbbell bars (29) to secure those weight plates.

Figure 7:
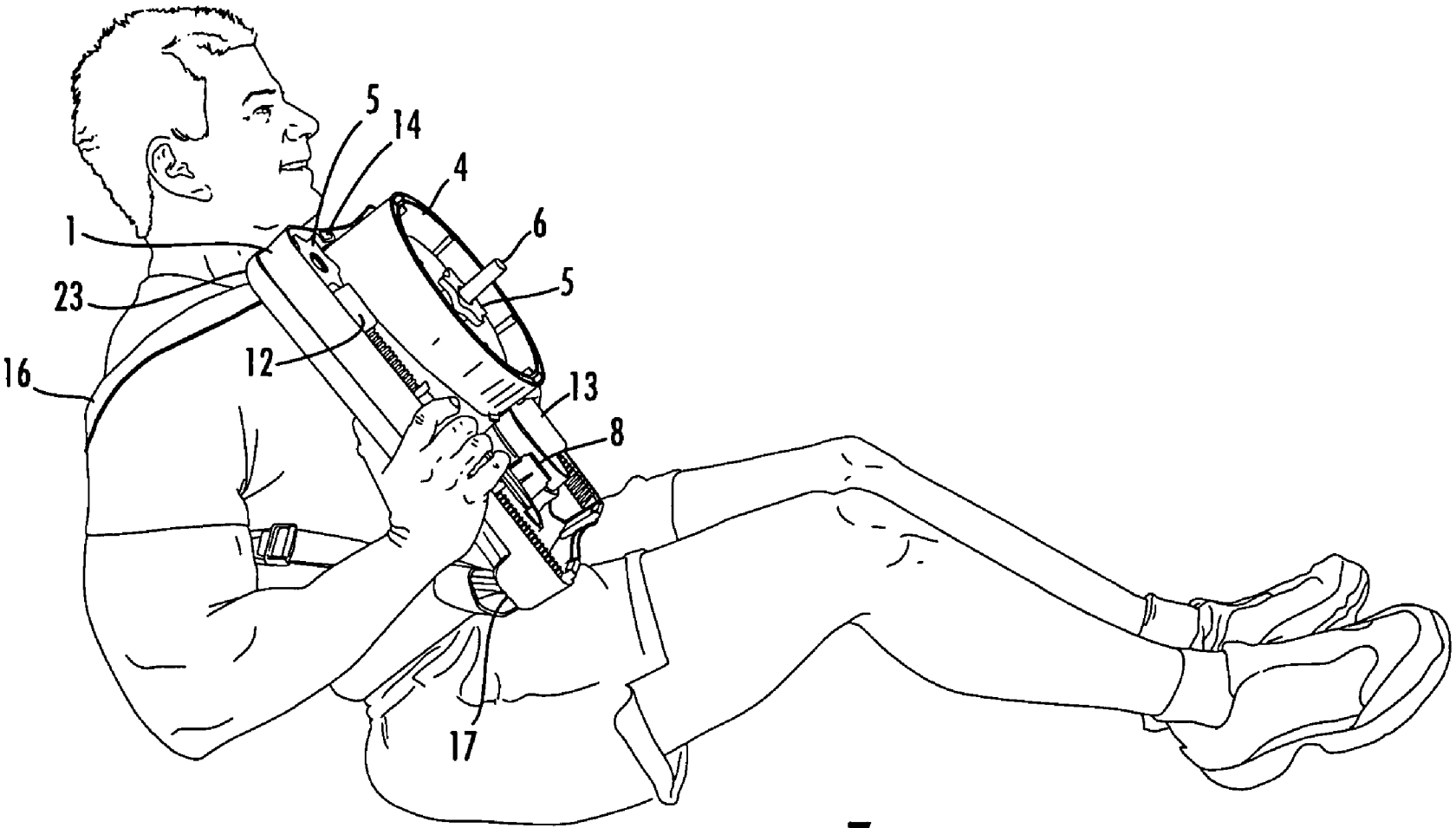
FIG. 7 is a view of the rear of the weighted open exercise equipment according to the present invention when on the user's chest doing weighted sit-ups without the rear cover when populated with the weight plates, hand grip stands, hand dumbbell bars, bar collars.

FIG. 7 illustrates the fitness equipment used in a sit-up position with the weighted base pack (1) resting on user's chest area. The base pack (1) has two lower semi-circular shaped molded cut-outs (15) for hand grips that allow user's hands to add more stability and balance to the lower portion of the base pack (1).

Figure 8:
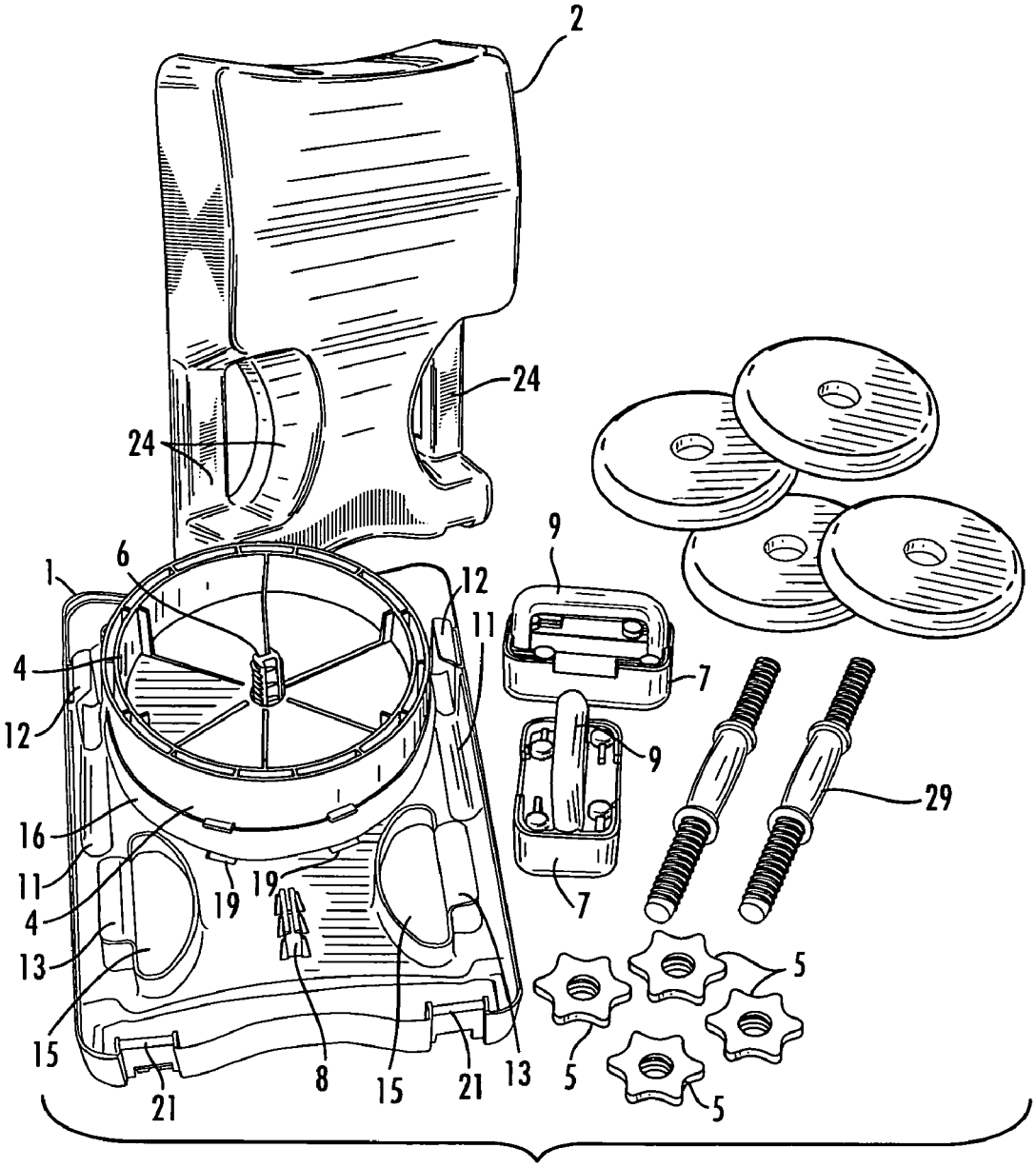
FIG. 8 is an elevated view of the exercise equipment according to the present invention when unpopulated and with the weight plates, hand grip stands, hand dumbbell bars, bar collars displayed, the combination forming a kit for exercise.

FIG. 8 shows the rear side components of base exercise pack. Shown in this view is a rear side molded cylinder shaped canister (4) with a threaded bar (6) extending through the center support wall (22) to secure several free weight plates to the base pack (1). The threaded bar (6) is not integrally formed with the base pack (1) and is in effect a pin for securing the weight plates to either side of the base pack.

The base support wall (22) between the front (3 )and rear canisters (4) acts as a support wall for which the weight plates can be pressed against and secured to the base without having the weight of the plates resting solely on the horizontal threaded bar (6). This aspect then allows the manufacturer to utilize a less expensive construction material resulting in less expensive cost. If the weight plates were secured solely on a horizontal bar extending from a vertical plane, then more rigid and expensive construction materials would be needed to prevent the bar from braking off the pack. The support wall between the canisters is preferably coplanar with the support wall of the base pack, although the invention is not limited to this embodiment.

Using the canisters and the support wall system to support the weight plates removes the weight bearing need of the horizontal threaded bar (6), allow it to essentially function as a pin to secure the weights, without having to bear significant if any weight in the vertical direction. The shoulder straps (16) thread through parallel but opposite left and right side inserts (18) on the top ends of the front and rear sides of the base pack (1) and then travel down the rear side of the base pack (1) and loop around and under the rear weight canister (4) and through the canister strap clips (19). This design adds an additional level strength and support to the rear canister (4) when loaded with weight plates. The base frame pack and covers, and components stored therein comprise an exercise kit that assists in fitness of the user.

Figure 9:
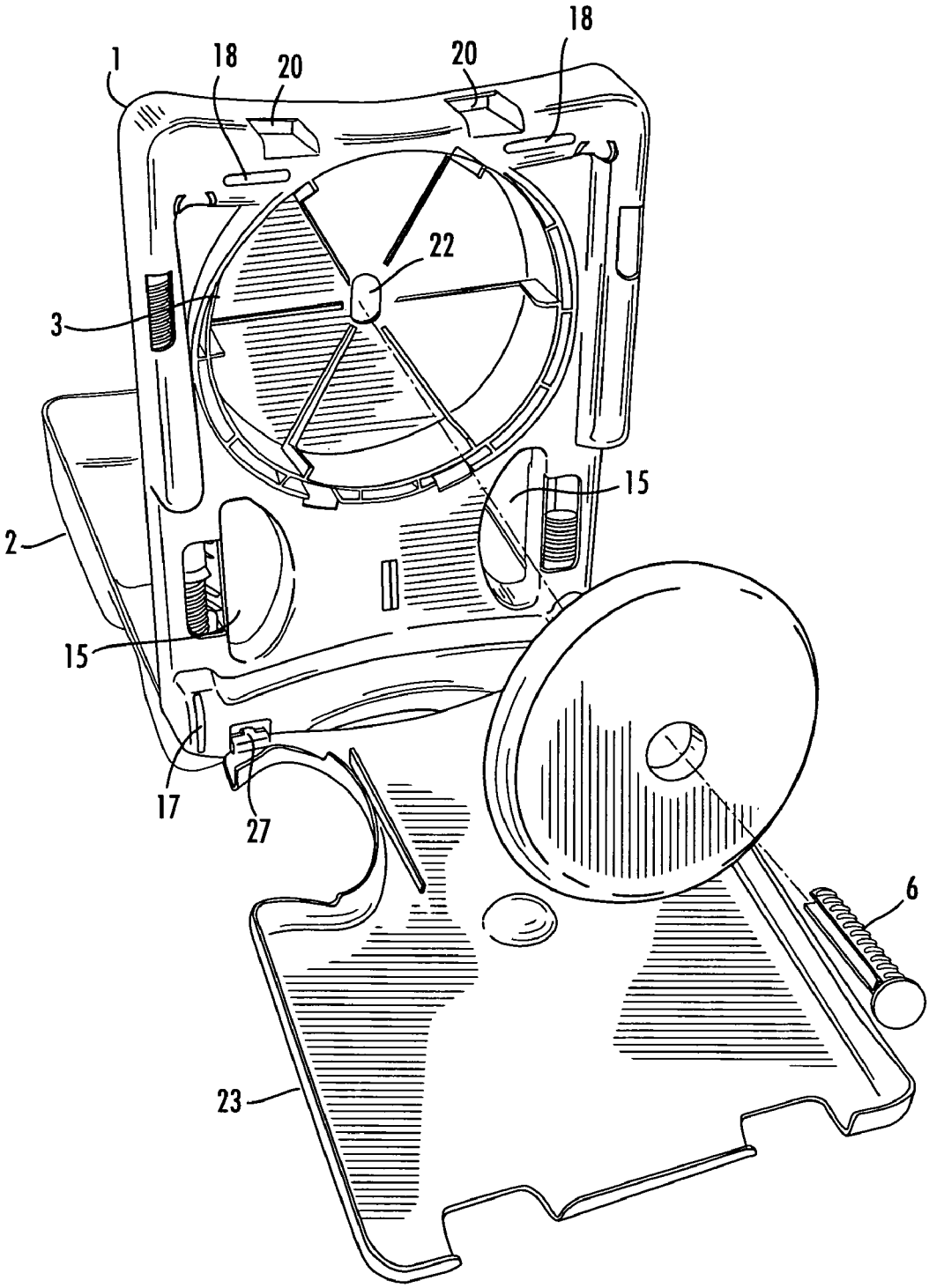
FIG. 9 is a front perspective exploded view of the exercise equipment according to the present invention when standing upright with front cover hinged opened exposing the front side container which holds the weight plates secured by a threaded pin.

FIG. 9 is an exploded view that shows the front side of the base exercise pack with lumbar support cover (23) in an open position. The front side of the unit comprises a molded cylinder shaped canister (3) for loading weight plates as described in this exploded view. A preferably threaded pin (or bar) (6) extends through the center support wall from the front side, with finger-screw head on that side of the threaded pin, to secure several free weight plates to the base pack (1).

Figure 10:
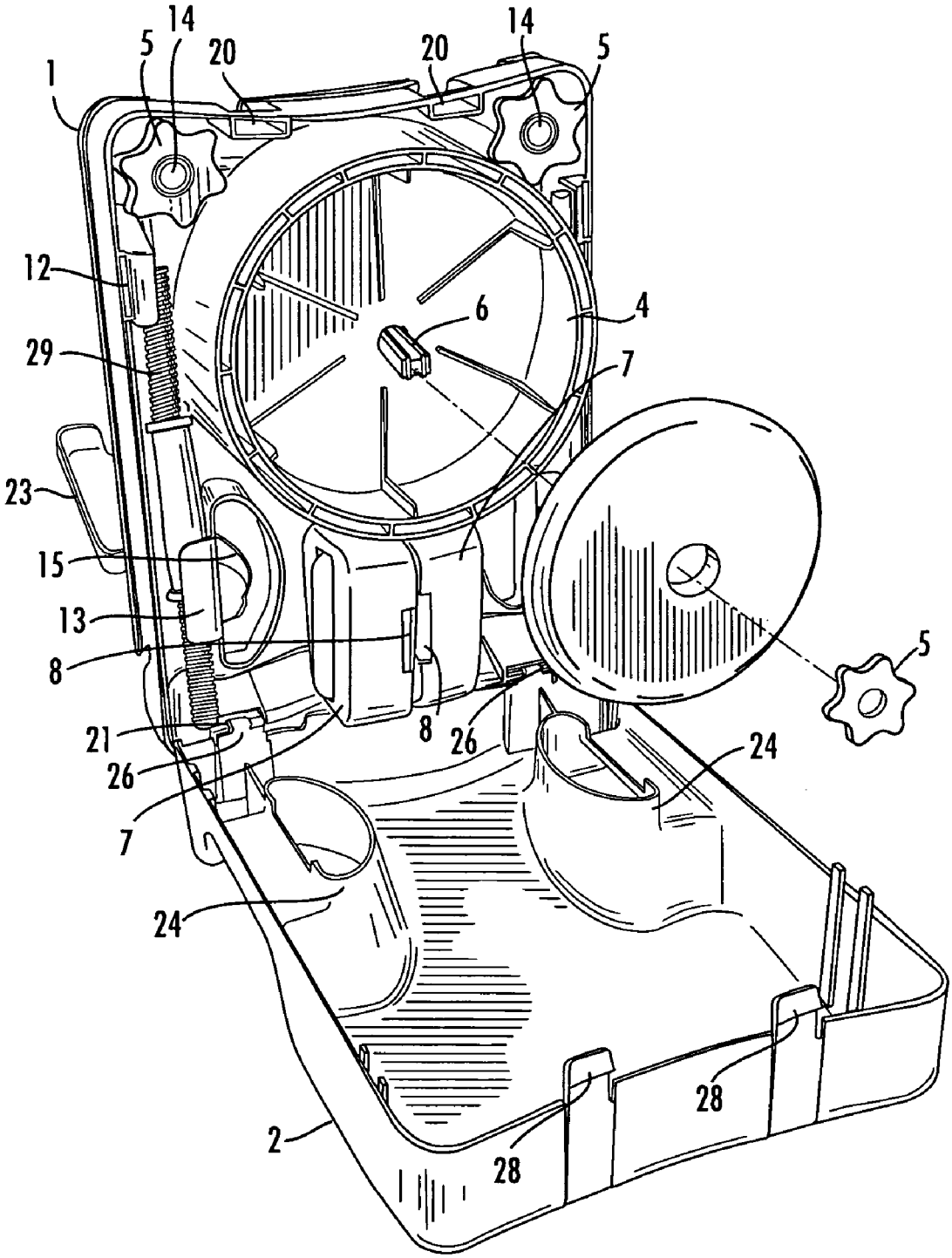
FIG. 10 is a rear perspective exploded view of the exercise equipment according to the present invention when standing upright with rear cover hinged opened exposing all components and the rear side container which holds the weight plates secured by collar screwed on the threaded pin.

FIG. 10 is an exploded view showing the rear side of the base exercise pack (1) with rear side storage cover (2 )in an open position. The rear side of the unit comprises a preferably molded cylinder shaped canister (4) for loading weight plates as shown in this exploded view. The threaded pin (6) extending through the center support wall from the front side with a threaded collar to secure several free weight plates to the base pack (1).

Figure 11:
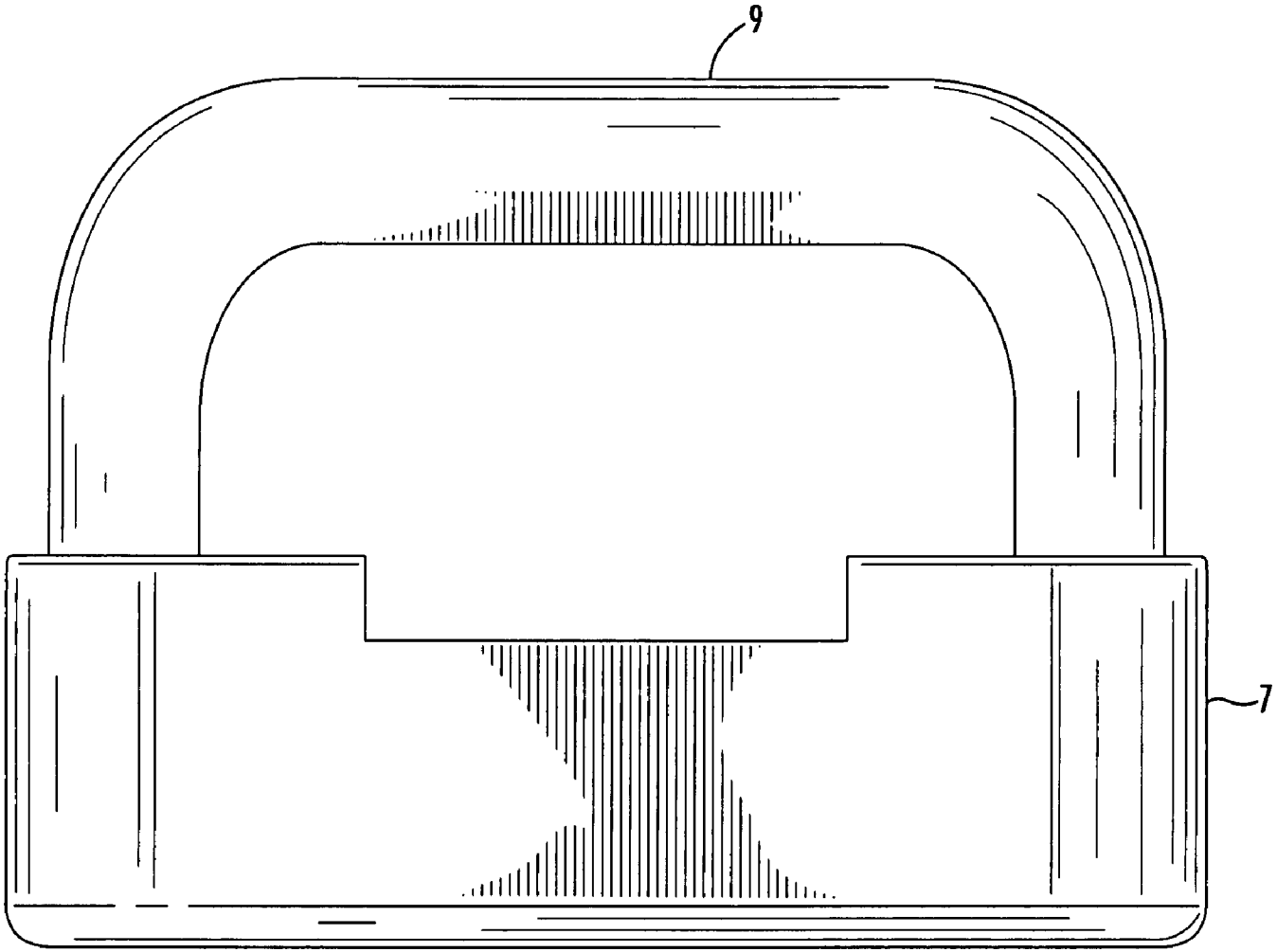
FIG. 11 is a side perspective of a hand-held push-up stand with base stand and semi-circle hand grip according to the present invention.
Figure 12:
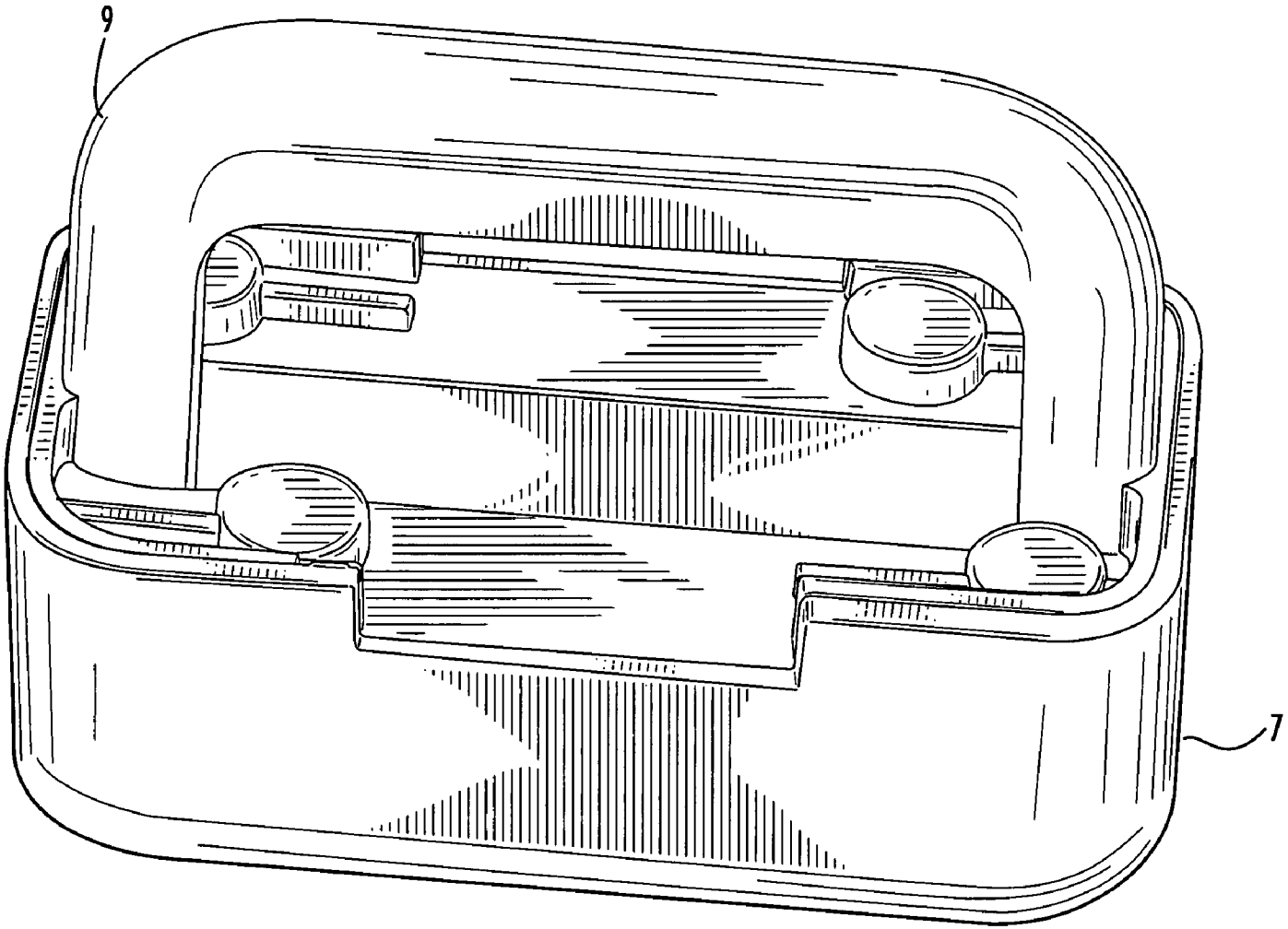
FIG. 12 is an elevated view of the hand-held push-up stand with base stand and semi-circle hand grip according to the present invention.

FIGS. 11 and 12 each illustrates one of the set of semi-circular push-up hand-grip stands (9) that can be detached from the base pack stand holders (8) and used to give the user a greater range of motion during the action of push-up.

The base pack (1) is described as being preferably molded. When molded so as to incorporate the canisters and the center support wall into the base pack, the pack can be made strong enough to support the weights, yet lightweight. In a preferred embodiment, the unit is injected molded from plastic or other similar easily molded material in the known manner. However, the unit may be made of any other lightweight material, such as, for example, aluminum, that could be, for example, cast into the form of the back pack described herein.

Various changes to the foregoing embodiments may be introduced without departing from spirit and scope of the present invention. The above-described embodiments are strictly illustrative in nature and do not limit the invention, the scope of which is defined in the following claims.

What is claimed is:

1. An exercise equipment pack adapted to assist a user in performing one or more exercises, the equipment pack comprising:

a base frame, the base frame including:

a front substantially-cylindrical canister portion, formed integrally with the base frame and projecting therefrom;

a rear substantially-cylindrical canister portion, formed integrally with the base frame, and projecting therefrom in a direction opposite from the front canister portion; and a common wall, formed integrally with the base frame and forming a common inner base surface for both the front canister portion and the rear canister portion, the common wall having an opening, the front canister portion, the rear canister portion and the common wall together forming a cylindrical storage area divided by the common wall, the cylindrical storage area being adapted to securely maintain one or more weights on each side of the common wall; and a first pin, the one or more weights, each having an opening therethrough, being securely fastenable to the base unit by means of the first pin passing through the openings in the one or more weights on the front side of the common wall, the opening in the common wall, and the openings in the one or more weights on the rear side of the common wall, the base frame further comprising one or more second pins, each second pin adapted to store a threaded collar.

2. The exercise equipment pack according to claim 1, the base frame further comprising one or more longitudinally disposed fitting slots on the rear side of the base frame and formed integrally therewith outside and laterally disposed from the rear canister portion, the one or more fitting slots being adapted to store one or more dumbbell bars.

3. The exercise equipment pack according to claim 2, wherein the one or more fitting slots are each formed by oppositely disposed flanges formed integrally with the base frame.

4. The exercise equipment pack according to claim 1, wherein the equipment pack is formed from molded plastic.

5. An exercise equipment pack adapted to assist a user in performing one or more exercises, the equipment pack comprising:

a base frame, the base frame including:

a front substantially-cylindrical canister portion, formed integrally with the base frame and projecting therefrom;

a rear substantially-cylindrical canister portion, formed integrally with the base frame, and projecting therefrom in a direction opposite from the front canister portion; and a common wall, formed integrally with the base frame and forming a common inner base surface for both the front canister portion and the rear canister portion, the common wall having an opening, the front canister portion, the rear canister portion and the common wall together forming a cylindrical storage area divided by the common wall, the cylindrical storage area being adapted to securely maintain one or more weights on each side of the common wall, the equipment pack further comprising front and rear covers, each hingedly attached to a portion of the base frame.

6. The exercise equipment pack according to claim 5, wherein when base frame includes a pair of cavities, one disposed at each lateral side of the base frame, the front cover and the rear cover cooperating to engage the cavities of the base frame in a closed position so as to form handles for the equipment pack.

7. An exercise equipment pack adapted to assist a user in performing one or more exercises, the equipment pack comprising:

a base frame, the base frame including:

a front substantially-cylindrical canister portion, formed integrally with the base frame and projecting therefrom;

a rear substantially-cylindrical canister portion, formed integrally with the base frame, and projecting therefrom in a direction opposite from the front canister portion; and a common wall, formed integrally with the base frame and forming a common inner base surface for both the front canister portion and the rear canister portion, the common wall having an opening, the front canister portion, the rear canister portion and the common wall together forming a cylindrical storage area divided by the common wall, the cylindrical storage area being adapted to securely maintain one or more weights on each side of the common wall, the base frame having openings at top and bottom portions thereof adapted to engage shoulder and/or waist straps for securely holding the exercise equipment to the user's body.

8. An exercise equipment kit comprising:

(1) an exercise equipment pack adapted to assist a user in performing one or more exercises, the equipment pack comprising:

(a) a base frame, the base frame including:

a front substantially-cylindrical canister portion, formed integrally with the base frame and projecting therefrom;

a rear substantially-cylindrical canister portion, formed integrally with the base frame, and projecting therefrom in a direction opposite from the front canister portion;

a common wall, formed integrally with the base frame and forming a common inner base surface for both the front canister portion and the rear canister portion, the common wall having an opening;

storage portions integrally formed in the base frame, the front canister portion, the rear canister portion and the common wall together forming a cylindrical storage area divided by the common wall, the cylindrical storage area being adapted to securely maintain one or more weights on each side of the common wall; and (b) a pin;

(2) the weights;

(3) one or more threaded collars;

(4) dumbbell handles, the dumbbell handles adapted to engage the weights and the threaded collars to form free weight dumbbells; and (5) push up stands.

* * * * *